United States Patent [19]

Kahelin

[11] 3,989,027

[45] Nov. 2, 1976

[54] MACHINE FOR PROPELLING BALLS OF VARIOUS DIAMETERS

[76] Inventor: Edward W. Kahelin, 812 Fifth St., Manhattan Beach, Calif. 90266

[22] Filed: Oct. 16, 1975

[21] Appl. No.: 622,898

[52] U.S. Cl. ..... 124/58; 124/50; 124/77; 124/84

[51] Int. Cl.[2] ..... F41F 1/04; F41F 17/00

[58] Field of Search ..... 124/50, 53, 56, 58, 124/70, 71, 72, 73, 74, 75, 76, 77, 83, 84, 85; 273/26 D, 29 A

[56] References Cited

UNITED STATES PATENTS

| | | | |
|---|---|---|---|
| 2,117,935 | 5/1938 | Benjamin et al. | 124/84 |
| 2,574,408 | 11/1951 | Moe | 124/73 |
| 3,018,769 | 1/1962 | Parsoneault | 124/56 |
| 3,584,614 | 6/1971 | Horvath | 124/56 |
| 3,680,540 | 8/1972 | Stengl | 124/73 |
| 3,818,887 | 6/1974 | Akiyama et al. | 124/67 |
| 3,838,676 | 10/1974 | Kahelin | 124/75 |
| 3,855,988 | 12/1974 | Sweeton | 124/56 |
| 3,905,349 | 9/1975 | Nielsen et al. | 124/56 |
| 3,915,143 | 10/1975 | Waller | 124/75 |
| 3,930,486 | 1/1976 | Kahelin | 124/75 |

*Primary Examiner*—Richard T. Stouffer
*Attorney, Agent, or Firm*—George W. Finch

[57] ABSTRACT

An improved compressed gas ball propelling machine having various barrel extensions each of which include a second breech and ball feeding mechanism so that the machine can be used to throw balls of various diameters. The breech and ball feeding mechanisms of each of the barrel extensions can be removably fastened to the original breech mechanism of the ball propelling machine in such a way as to be operatively connected thereto so the machine can propel balls of a diameter for which the machine was originally intended or balls of different diameters.

9 Claims, 3 Drawing Figures

MACHINE FOR PROPELLING BALLS OF VARIOUS DIAMETERS

CROSS-REFERENCE TO RELATED INVENTIONS

The present invention is an improvement to the apparatus shown and described in U.S. Pat. No. 3,838,676, entitled "Ball Throwing Machine With Barrel Extension" which issued Oct. 1, 1974 to Edward W. Kahelin, the inventor of the present device, and U.S. Pat. Application Ser. No. 479,747, which was filed 17 June 1974, now U.S. Pat. No. 3,930,486, invented and owned by the present inventor. The information contained therein is incorporated into this specification as though fully set forth below.

BACKGROUND OF THE PRESENT INVENTION

Various ball games such as baseball, softball, tennis, volleyball, table tennis, soccer, squash and handball require practice at hitting, catching, retrieving, returning or other specific maneuvers to achieve proficiency in the game. Hence propelling the ball repeatedly with accuracy into a predetermined area of the air or along the playing surface is very desirable in the practice and the training of a participant. A machine is preferable for propulsion of the ball since the desired velocities, spins, curves, and accuracies cannot always be obtained by a person.

An excellent machine for throwing baseballs and tennis balls at constant velocity and with consistent accuracy is known as the "Fireball," a trademark of K-Lin Specialties Inc. of Manhattan Beach, California. It reflects the teaching of the previously mentioned Kahelin patent and application and is used during practice sessions by teams in professional leagues, schools, Little League, and by park and playground teams. It is light, mobile, easy to erect for use and easy to disassemble for transportation and storage. In the Fireball machine, balls are automatically fed down a chute into a propulsion chamber through a ball entrance opening or breech behind which is a chamber for supplying the compressed gas which propels the balls one at a time and at predetermined intervals out of a barrel. A sleeve automatically covers the breech before the ball is propelled to prevent the compressed gas from escaping from the opening. The machine also has a barrel attachment at its muzzle end for imparting a selected spin to the ball as it leaves the barrel to stabilize the ball or make its flight similar to the flight of balls thrown or struck during normal play of the game.

It must be realized that such a machine is a precision device and although relatively economical it is, of course, more expensive than the usual expedient of providing a highly trained player to produce the proper motion of the ball. It should also be realized that tennis and baseballs are approximately the same size so that a single barrel can be used to propel the balls without substantial modification. However, tennis and baseball are primarily summer sports and therefore there has been a need to adapt such a machine to other sports so that it can be used the year around thereby enabling additionaal utilization of the machine without substantially increasing the cost thereof. For example, handball, volleyball and squash which are played indoors, tend to be winter sports. In addition, softball and baseball are summer sports which are usually played in a school situation at different times during the day, that is, softball is played during normal school hours due to the reduced space required, whereas baseball is played after normal school hours when more space is available. Thus it can be seen that means to enable the propulsion of various sized balls can greatly enhance the value and usefulness of a basic Fireball machine.

SUMMARY OF THE PRESENT INVENTION

The present invention relates to removable barrel extensions and other mechanisms for pneumatic ball propelling machine such as the Fireball to enable the propelling of balls of diameters other than those originally intended to be propelled. The extensions include means for connecting onto the barrel of the Fireball machine adjacent its original breech mechanism, a second breech mechanism sized to the ball to be propelled, and an automatic feed for dropping a ball into the second breech as the second breech is opened after the firing of the previous ball. A properly sized barrel and ball spinning device is included for controlling the direction of propulsion and for imparting the desired spin to the propelled ball. Differential motion means connect the motion of the first breech mechanism to the second breech mechanism and to the automatic feed so that the second breech is opened and closed a distance proportionate to the size of the ball to be propelled in phase with the automatic ball feed. In addition, a delay timer may be incorporated so that the proper amount of gas pressure can be built up within the machine before the cycle of propulsion is started. This is needed since in most instances the larger the ball, the more gas pressure is required to propel it.

It is therefore an object of the present invention to increase the versatility of a pneumatic ball throwing machine.

Another object is to provide means for propelling balls of different diameters from a single pneumatic ball throwing mechanism.

Another object is to provide a multi-purpose ball propelling machine.

Another object is to provide a multi-purpose ball propelling machine.

Another object is to provide a modified barrel assembly for a compressed gas ball propelling machine which is relatively easy to install, economical to manufacture and trouble-free.

These and other objects and advantages of the present invention will become apparent to those skilled in the art after considering the following detailed specification which covers preferred embodiments of the subject modification in conjunction with the accompanying drawings wherein:

DESCRIPTION OF THE PRESENT EMBODIMENTS

Figure 1:
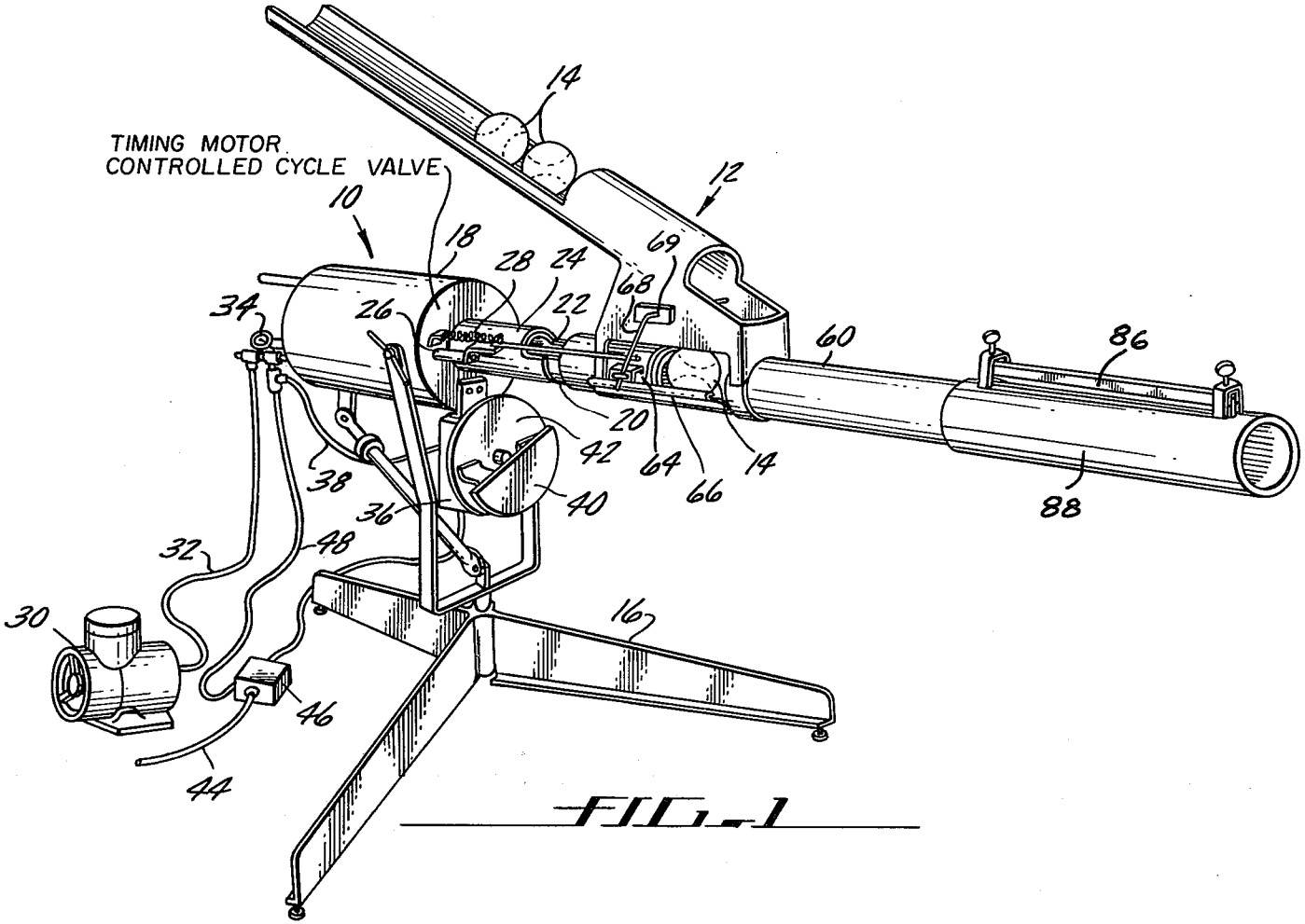
FIG. 1 is a perspective view of a ball throwing machine having a barrel extension constructed in accordance with the present invention.

Referring to the drawings more particularly by reference numbers, number 10 in FIG. 1 refers to a ball propelling machine having a modified barrel extension 12 constructed according to the present invention which is adapted to propel softballs 14. Although softballs 14 and a short tripod 16 are shown, whereby the ball propelling machine is used to simulate the underhand pitching used in softball, it should be realized that balls of other sizes such as table tennis balls, hand-balls, squash balls, volleyballs, basketballs, soccer balls and the like could be projected if the extension 12 were so sized. Tripods of different heights can also be used.

The machine 10 as shown in the referenced patent includes a compression tank 18 having a barrel 20 extending forwardly therefrom The barrel 20 includes a breech 22 into which the balls are normally placed prior to ejection. During normal ejection, the breech 22 is closed by a sleeve 24 which slides over the barrel 20 to close the breech 22 to prevent loss of the compressed gas which is used to eject the ball from the barrel 20. The sleeve 24 is driven forwardly along the barrel 20 by means of a pneumatically driven rod 26 connected thereto by a bracket 27. The sleeve 24 is moved rearwardly by a spring 28 when the pneumatic pressure behind the rod 26 is relieved by the ejection of the ball.

An air compressor 30 can be used as the source of compressed gas. The compressed air is fed to the compression tank 18 by means of line 32. A pressure regulator 34 between the line 32 and the compression tank 18 controls the pressure within the tank 18 so that it does not exceed predetermined and selectable levels.

A timing motor 36, whose output signals are transmitted along line 38, is used to actuate a cycle valve which is within the compression tank 18. The cycle valve releases the compressed air from the tank 18 into the barrel 20 to eject the ball.

The player can tell when a ball is about to be ejected by watching a semi-circular member 40 rotate in front of a disc 42. The semi-circular member 40 rotates in phase with the timing motor 36 and is driven thereby. Usually, the member 40 and disc 42 have contrasting colored portions so that the rotation of the semi-circular member 40 and the location thereof can be seen at relatively long distances.

Electrical power for the timing motor 36 is transmitted along line 44 which optionally may include a pressure sensitive switch 46 which interrupts the electrical power to the timing motor 36 when sufficient pressure is not sensed in the line 48 connecting the switch 46 to the compression tank side of the regulator 34. The switch 46 is used when the compressor 30 does not have sufficient capacity to completely charge the compression tank 18 to the desired pressure for ejecting balls with the desired velocity in the normally alotted time. This is the usual case when the machine 10 is originally designed to project baseballs and tennis balls and is being used to eject larger balls such as softballs, volleyballs, soccer balls, or basketballs. For example, approximately 30 p.s.i. (2.1 kg/cm$^2$) is sufficient to impart velocities into a baseball similar to those that can be imparted by a human pitcher.

Figure 2:
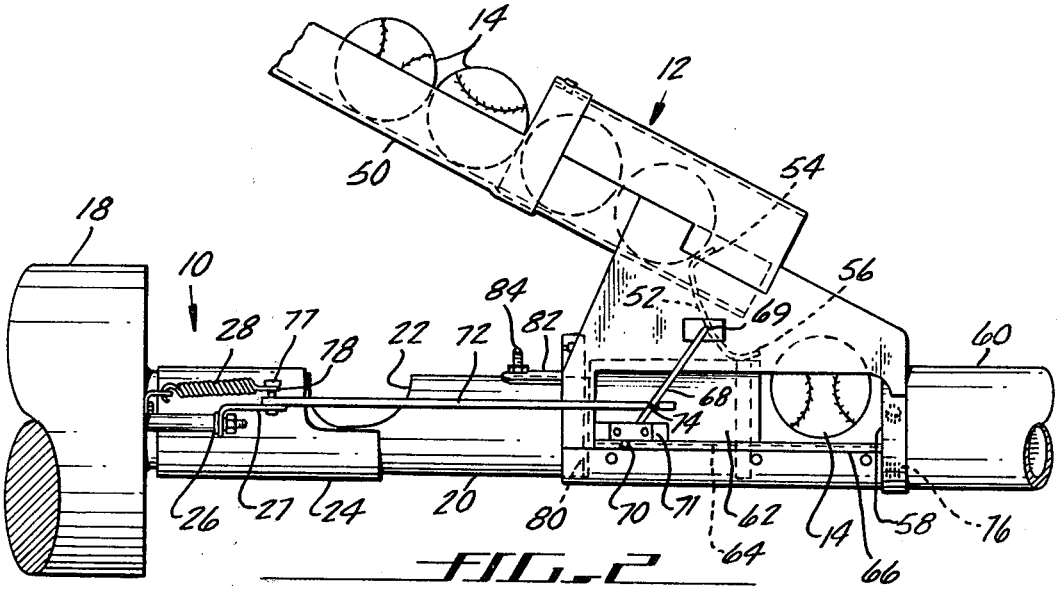
FIG. 2 is an enlarged, partial side view of the machine of FIG. 1 with the breeches thereof in their open positions.

The balls 14 whose diameter differs from that of baseballs or tennis balls are introduced by means of the barrel extension 12 which includes a feed chute 50 which is shown in U.S. Pat. Application Ser. No. 3,930,486 as a cutaway tube. The balls 14 are placed in the feed chute 50 and are prevented from further motion by means of a double ended abutment arm 52 which has two upstanding abutment portions 54 and 56, as shown in FIG. 2. The upstanding abutment portion 54 prevents release of the remaining balls 14 when a ball is released by the downward movement of the upstanding abutment portion 56 as a second breech 58 is opened to receive the ball 14.

The second breech 58 is comprised of a cutout in a barrel extension 60 of suitable diameter. The second breech 58 is opened and closed by means of a semi-circular sleeve 62 which slides with respect to the barrel 60 by means of radially outwardly extending tangs 64 which slide in inwardly facing channel members 66 connected to the barrel 60 adjacent the breech 58 at the opposite sides thereof.

The movement of the sleeve 62 is caused by motion of the pneumatically driven rod 26 which is differentially connected thereto by means of an arm 68. The arm 68 as shown is supported for rotation by a pivot 69 located above the barrel 60 and is connected to the abutment arm 52 so that rotation thereof is translated into upward and downward movement of the upstanding abutment portions 54 and 56 to release the balls 14 in phase with the movement of the rod 26 and its attached primary breech covering sleeve 24. The opposite end 70 of the arm 68 is operatively connected to the secondary breech covering sleeve 62 by means of a bracket 71. The motion of the rod 26 is connected through the bracket 27 to a drive rod 72 by means of a pin 74, which rod 72 connects to the arm 68.

Of course if smaller balls are being used, the extension 12 will have a smaller barrel 60 than the standard barrel 20 and therefore, a smaller secondary breech 58. In this latter instance, the drive rod 72 can be attached to the arm 68 by means of a pin similar to pin 74 located below the bracket 71 so the motion of the smaller sleeve analogous to sleeve 62 is smaller than the motion of the sleeve 24. It is generally desirable to keep the breech opening and covering sleeve as small as possible so that losses associated with imperfect sealing therebetween do not lessen substantially the ejection velocities of the machine.

Figure 3:
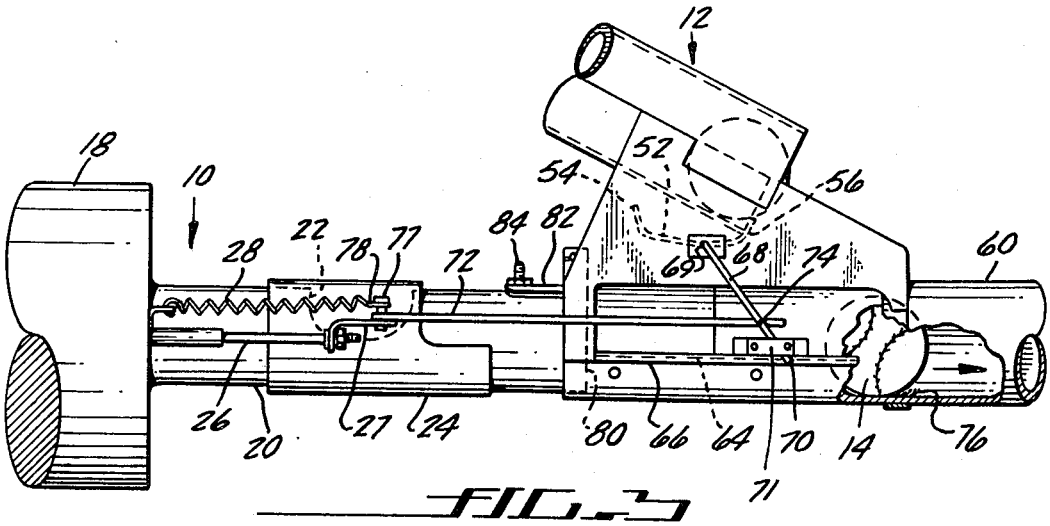
FIG. 3 is a partially cutaway view similar to FIG. 2 with the breeches in their closed positions.

The complete action of the extension 12 can be further understood by reference to FIG. 3 wherein the drive rod 72 and arm 68 have driven the sleeve 62 to close the breech 58 after a ball 14 has been dropped thereinto. As can be seen, the upstanding abutment portion 56 is restraining the next ball in line in preparation for the movement of the sleeve 62 and the opening of the breech 58 for reloading and firing. In the cutaway portion of FIG. 3, the ball 14 can be seen commencing its travel over ball retention means which are shown as a small brush 76, although many other devices such as spring loaded nibs can be employed, to assure that the ball 14 does not roll down the barrel prior to the application of the compressed gas to its backside.

FIG. 3 also shows the spring 28 which is stretched between the tank 18 and the pin 77 which releasably connects the drive rod 72 to the bracket 27 and the pneumatically driven rod 26. Once the pressure within the tank 18 has been relieved by the ejection of the ball 14, the spring 28 will force the rod 26 back into the tank 18 thereby moving the sleeves 24 and 62 to their open positions so that a ball can be released into the breech 58. The spring hook 78 which connects the spring 28 to the pin 74 also can be used as a releasable keeper for the rod 72.

The extension 12 is normally constructed with a collar 80 shown in dotted outline which sealably attaches about the barrel 20. The extension 12 is retained to the machine 10 by suitable means such as the bracket 82 and the bolt 84 shown. The bolt 84 and bracket 82 assure the proper longitudinal spacing of the extension 12 with respect to the original breech drive mechanism so that the sleeve 62 opens and closes in the proper fashion.

Referring again to FIG. 1 it can be seen that suitable ball spinning means 86 are employed at the muzzle 88 of the barrel 60. Such means are shown in reference patents and here are modified in diameter so that they can impart the proper spin to the projected ball.

Thus there has been shown and described a novel machine which through the use of modified barrel extensions of various diameters, can be used to propel balls of various diameters which fulfills all of the objects and advantages sought therefor. Many changes, modifications, variations and other uses and applications of the subject machine will, however, become apparent to those skilled in art after considering this specification and the accompanying drawings. All such changes, modifications, alterations and other uses and applications which do not depart from the spirit and scope of this invention are deemed to be covered by this invention which is limited only by the claims which follow.

What is claimed is:

1. A ball propelling machine including a barrel of a first predetermined inside diameter for propelling a ball of substantially said first predetermined diameter, pneumatic means for propelling the ball out of the barrel, the barrel including a first breech and a first breech cover movable to open and close the first breech and means to move the first breech cover in phase with the pneumatic means, the improvement comprising:

a second barrel of a second predetermined inside diameter for propelling a ball of substantially said second predetermined diameter, said second barrel including a second breech cover movable to open and close said second breech;

means for sealably coaxably attaching said second barrel to the first barrel; and means connecting said second breech cover to the first breech cover to move said second breech cover in conjunction with movement of said first breech cover.

2. The ball propelling machine defined in claim 1 including;

feed means to place a ball to be propelled into said second breech when said second breech cover is open.

3. The ball propelling machine defined in claim 2 wherein said feed means include:

a chute for storing a supply of balls to be propelled; and means for releasing one ball as said second breech cover opens including a pivoting rod connected to said second breech cover.

4. The ball propelling machine defined in claim 3 wherein the means connecting said second breech cover to the first breech cover include:

a rod connected between the first breech cover and said pivoting rod, said pivoting rod being pivoted to a portion of said chute.

5. The ball propelling machine defined in claim 4 including a ball to be propelled therefrom, wherein said propelled ball has a larger diameter than the first barrel, said rod being connected to said pivoting rod between said portion of said chute and said second breech cover, said second barrel being sized in inside diameter appropriate to the diameter of said ball.

6. The ball propelling machine defined in claim 4 including a ball to be propelled therefrom, wherein said propelled ball has a smaller diameter than the first barrel, said rod being connected to said pivoting rod opposite said second breech cover from said portion of said chute, said second barrel being sized in inside diameter to the diameter appropriate of said ball.

7. The ball propelling machine defined in claim 5 wherein the pneumatic means include:

a gas storage tank;

a gas supply;

means to feed gas from said supply to said tank;

electrical valve means to release the gas from said storage tank into the first barrel, and means to sense the gas pressure in said storage tank, said last named means including means to delay the release of gas by said electrical valve means until a predetermined gas pressure is present in said storage tank.

8. The ball propelling machine defined in claim 7 wherein said second barrel includes a muzzle which has means to induce a predetermined spin to the propelled ball.

9. The ball propelling machine defined in claim 6 wherein said second barrel includes a muzzle which has means to induce a predetermined spin to the propelled ball.

* * * * *